US009167358B2

(12) United States Patent
Fischer

(10) Patent No.: US 9,167,358 B2
(45) Date of Patent: Oct. 20, 2015

(54) METHOD FOR THE BINAURAL LEFT-RIGHT LOCALIZATION FOR HEARING INSTRUMENTS

(75) Inventor: Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 392 days.

(21) Appl. No.: 13/579,987

(22) PCT Filed: Jul. 7, 2010

(86) PCT No.: PCT/EP2010/059686

§ 371 (c)(1),
(2), (4) Date: Aug. 20, 2012

(87) PCT Pub. No.: WO2011/101042

PCT Pub. Date: Aug. 25, 2011

(65) Prior Publication Data

US 2012/0321092 A1 Dec. 20, 2012

(30) Foreign Application Priority Data

Feb. 19, 2010 (EP) ..... 10154096

(51) Int. Cl.
*H04R 5/00* (2006.01)
*H04R 25/00* (2006.01)

(52) U.S. Cl.
CPC ..... *H04R 25/407* (2013.01); *H04R 25/552* (2013.01); *H04R 2225/43* (2013.01); *H04R 2410/01* (2013.01); *H04R 2430/21* (2013.01)

(58) Field of Classification Search
CPC ..... H04R 2225/43; H04R 2410/01; H04R 2430/21; H04R 25/407; H04R 25/552
USPC ..... 381/23.1, 71.1–71.8, 94.1–94.4, 104, 381/92, 91, 355, 356, 369, 120; 704/225, 704/226
See application file for complete search history.

(56) References Cited

U.S. PATENT DOCUMENTS

2003/0147538 A1* 8/2003 Elko ..... 381/92
2004/0196994 A1* 10/2004 Kates ..... 381/320

(Continued)

FOREIGN PATENT DOCUMENTS

CN 101505447 A 8/2009
CN 101711007 A 5/2010

(Continued)

OTHER PUBLICATIONS

Li, J., et al., "Two-stage binaural speech enhancement with Wiener filter based on equalization-cancellation model", IEEE Workshop on Applications of Signal Processing to Audio and Acoustics, Oct. 18-21, 2009, pp. 133-136, New Paltz, New York.

(Continued)

*Primary Examiner* — Lun-See Lao
(74) *Attorney, Agent, or Firm* — Laurence A. Greenberg; Werner H. Stemer; Ralph E. Locher

(57) ABSTRACT

A method and system for improving signal-to-noise ratio of output signals of a microphone system having two or more microphones due to acoustic useful signals at sides of the system are used in hearing instruments, especially hearing aids worn on the head. High and low frequency portions (cut-off frequency between 700 Hz and 1.5 kHz, approx. 1 kHz) are processed differently. In low frequency ranges, differential microphone signals directed towards left right are produced to determine lateral useful and noise sound levels using these two directional signals. These levels are used for subjecting every microphone signal to individual Wiener filtering. The natural head shadowing effect is used in high frequency ranges as a pre-filter for noise and useful sound estimation for subsequent Wiener filtering. The methods are used in hearing instruments worn on the head individually for high or low frequencies or in combination and complement each other.

20 Claims, 4 Drawing Sheets

(56) References Cited

U.S. PATENT DOCUMENTS

| | | | | |
|---|---|---|---|---|
| 2009/0202091 | A1 | 8/2009 | Pedersen et al. | |
| 2009/0238385 | A1 * | 9/2009 | Fischer | 381/312 |
| 2010/0046775 | A1 | 2/2010 | Tiefenau | |
| 2010/0280825 | A1 * | 11/2010 | Takano et al. | 704/225 |
| 2012/0128164 | A1 | 5/2012 | Blamey | |
| 2012/0321092 | A1 | 12/2012 | Fischer | |

FOREIGN PATENT DOCUMENTS

| | | | |
|---|---|---|---|
| CN | 102783185 | A | 11/2012 |
| EP | 1 465 456 | A2 | 10/2004 |
| EP | 2 104 377 | A2 | 9/2009 |
| WO | 2010/022456 | A1 | 3/2010 |

OTHER PUBLICATIONS

Kates, J.,"Microphone Arrays/Binaural Noise Suppression" in "Digital Hearing Aids", 2008, pp. 136-146 and 416-425, Plural Publishing, San Diego, CA, USA, XP002632569, ISBN: 978-1-59756-317-8.

* cited by examiner

METHOD FOR THE BINAURAL LEFT-RIGHT LOCALIZATION FOR HEARING INSTRUMENTS

BACKGROUND OF THE INVENTION

Field of the Invention

The invention relates to a method and a system for improving the signal-to-noise ratio of output signals of a microphone system of two or more microphones due to acoustic useful signals occurring at the sides of the microphone system. Such a method and system can be used in hearing instruments, in particular in hearing aids which can be worn on the head of a hearing aid user. In this situation, at the sides should in particular be understood as meaning to the right and to the left of the head of the wearer of a binaural hearing aid arrangement.

Conventional directivity methods which have been utilized in hearing aids hitherto offer the capability to distinguish between signals or noises which reach the hearing aid user from the front or from behind and the other ambient noises, in order to thereby increase the speech intelligibility. They do not however offer the capability to emphasize signals or noises from a lateral source which reach the hearing aid user from the left or from the right.

Hearing aids already known merely offer the capability to accentuate such lateral signals somewhat by transmitting the signal from the desired side to both ears. To this end, audio signals are transmitted from one ear to the other and played there. This means however that a mono signal is presented to the hearing aid user, with the consequence that signal characteristics which make it possible to localize sound sources ('binaural cues') are lost. Such signal characteristics can for example be interaural level differences, in other words the fact that the level at the ear or hearing aid facing the noise or the signal source is higher than at the ear or hearing aid facing away.

The calculation of a conventional differential directional microphone is not a solution which can be applied without restriction, partly because in the case of signals having high frequency components no differential directional microphone is possible without spatial ambiguities on account of so-called "spatial aliasing".

Such spatial ambiguities, in other words the inability to clearly associate the spatial origin of a signal any longer, come into being when the right and left microphone signals of an acoustic source signal are subtracted from one another. The differential processing by subtraction of the microphone signals normally makes it possible to predefine a directional sensitivity of the microphone system in a desired direction. If however the wavelength of the acoustic source signals is too small in comparison with the spatial distance between the microphones of the microphone system, it is then possible to determine the spatial origin of a source signal only with twofold or multiple ambiguity.

BRIEF SUMMARY OF THE INVENTION

The object of the invention is to specify an improvement in the noise signal to useful signal ratio in the case of acoustic signals taking into consideration a spatial direction of the signal source.

The object is achieved by the invention in that it is regarded as a classic noise reduction problem. In the manner described below, a binaural noise signal and a binaural useful signal are determined or estimated which are used as input signals for a suitable filter, for example a Wiener filter, in which an amplification factor which is of equal magnitude for both ears is calculated and applied preferably for each frequency band. The interaural level differences are maintained as a result of applying the same amplification factor for both ears, in other words the localization of sounds or sound sources is made possible.

A basic concept of the invention consists in processing high and low frequency components (cutoff frequency in the range between 700 Hz and 1.5 kHz, for example approx. 1 kHz) differently. For low frequency ranges a filtering takes place, preferably likewise a Wiener filtering, on the basis of a differential preprocessing based on the calculation of a differential binaural directional microphone, whereby one signal directed towards the left and one signal directed towards the right are produced by the preprocessing, usually with opposite directional cardioid characteristics (kidney-shaped directional sensitivity).

These two signals directed towards the left and towards the right based on a conventional differential directional microphone are used as the basis for estimating the level of lateral useful and noise sound, said estimates in turn being used as input variables for the filtering, preferably Wiener filtering.

Said filtering is subsequently applied separately to each of the microphone signals of the microphone system and not to the common differential directional microphone signal of the binaural arrangement, which has been calculated as the output signal of the conventional directional microphone.

The advantage for example compared with the use of omni signals consists in the fact that as a result of the upstream directionality greater differences between left side and right side are produced to a certain extent artificially which manifest themselves in an increased noise sound suppression of signals which arrive from the direction to be suppressed.

An advantageous development provides that in low frequency ranges a pre-filtering on the basis of the calculation of a conventional differential directional microphone and subsequent filtering, preferably Wiener filtering, are carried out as described above, and in high frequency ranges (cutoff frequency in the range between 700 Hz and 1.5 kHz, for example approx. 1 kHz) the natural shadowing effect of the head is used as a pre-filter for noise and useful sound estimation for a subsequent Wiener filtering.

The determination of the noise and useful sound estimate by utilizing the shadowing effect of the head takes place in the following manner: the monaural signal facing the desired side is used as the useful signal estimate, and the monaural signal facing away is used as the noise signal estimate. This is possible because in particular in the case of higher frequencies (>700 Hz or >1 kHz) the shadowing effect of the head causes a considerable attenuation of the signal on the side facing away.

Said two signals directed to the left and to the right based on a signal pre-filtered by the shadowing effect of the head are used as the basis for the estimation of the level of lateral useful and noise sound, and said estimates are in turn used as input variables for the filtering, preferably Wiener filtering.

Said filtering is subsequently applied separately to each of the microphone signals of the microphone system.

The advantage for example compared with the use of omni signals consists in the fact that as a result of the upstream directionality greater differences between left side and right side are produced to a certain extent artificially which manifest themselves in an increased noise sound suppression of signals which arrive from the direction to be suppressed.

As a result of the respective preprocessing, one signal directed towards the left and one signal directed towards the right are produced in each case for the low and the high frequency range respectively, usually with opposite directional cardioid characteristics (kidney-shaped directional sensitivity). Said respective directional signals are used are used as the basis for estimating respective lateral useful and noise sound levels. The respective useful and noise sound levels are in turn used as input variables for the filtering, preferably Wiener filtering. As a result of the combination of the respective filtering method for high and for low frequency ranges, it is thus possible to achieve filtering over the entire frequency range.

In a further advantageous development, the acoustic signals are split into frequency bands and the filtering, preferably Wiener filtering, is carried out specifically for each of the frequency bands.

In a further advantageous development, the filtering, preferably Wiener filtering, is carried out direction-dependently. The direction-dependent filtering can be carried out in a conventional manner.

Advantageously, one or more of the following parameter values is determined or estimated as the useful signal level and/or as the noise signal level: energy, power, amplitude, smoothed amplitude, averaged amplitude, level.

BRIEF DESCRIPTION OF THE SEVERAL VIEWS OF THE DRAWING

Further advantageous developments and advantages are set down in the dependent claims and the following figures together with the description. In the drawings:

DESCRIPTION OF THE INVENTION

Figure 1:
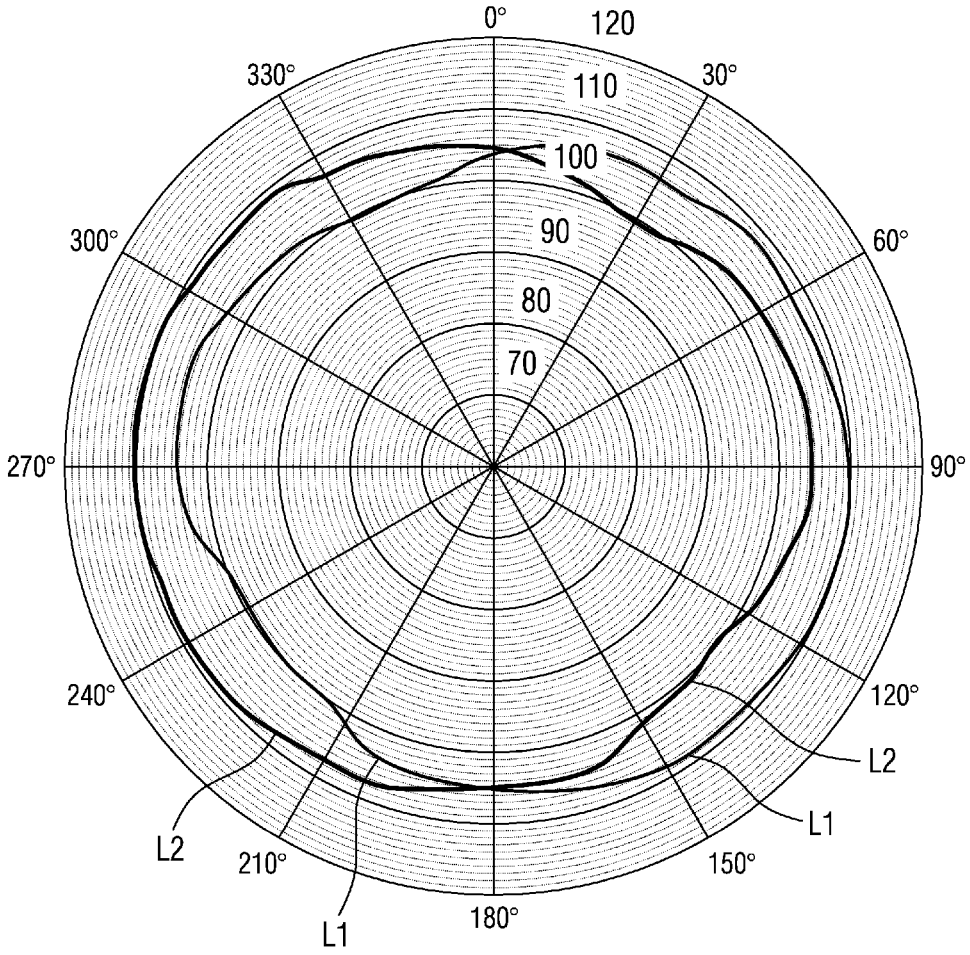
FIG. 1 shows levels from the left-side and right-side microphones for a circumferential signal at 1 kHz

FIG. 1 illustrates the levels of the hearing aid microphones or microphone systems of the left (provided with reference character L2 in the figure) and right (reference character L1) ear sides of a binaural hearing aid arrangement for a circumferential signal, in other words for a signal source positioned in the illustrated circumferential spatial directions, at 1 kHz. A difference of 6-10 dB can be recognized, in other words the level L2 of the left-side microphone or microphone system is 6-10 dB higher for a left-side signal (270°) than the level L1 of the right-side microphone or microphone system; at higher frequencies, said level difference increases further.

If the user now wishes for example to listen towards the left) (270°), then the right-side signal L1 is used as the noise sound signal, the left-side L2 as the useful sound signal. On the basis of said noise sound and useful sound signals, it is then possible to estimate the input variables for a filtering, for example a Wiener filtering.

For the Wiener filtering, respective useful signal and noise signal levels are determined or estimated from the useful signal and the noise signal. Said levels are used as input variables for a Wiener filter, therefore:

Wiener filter=useful signal level/(useful signal level+noise signal level)

Figure 2:
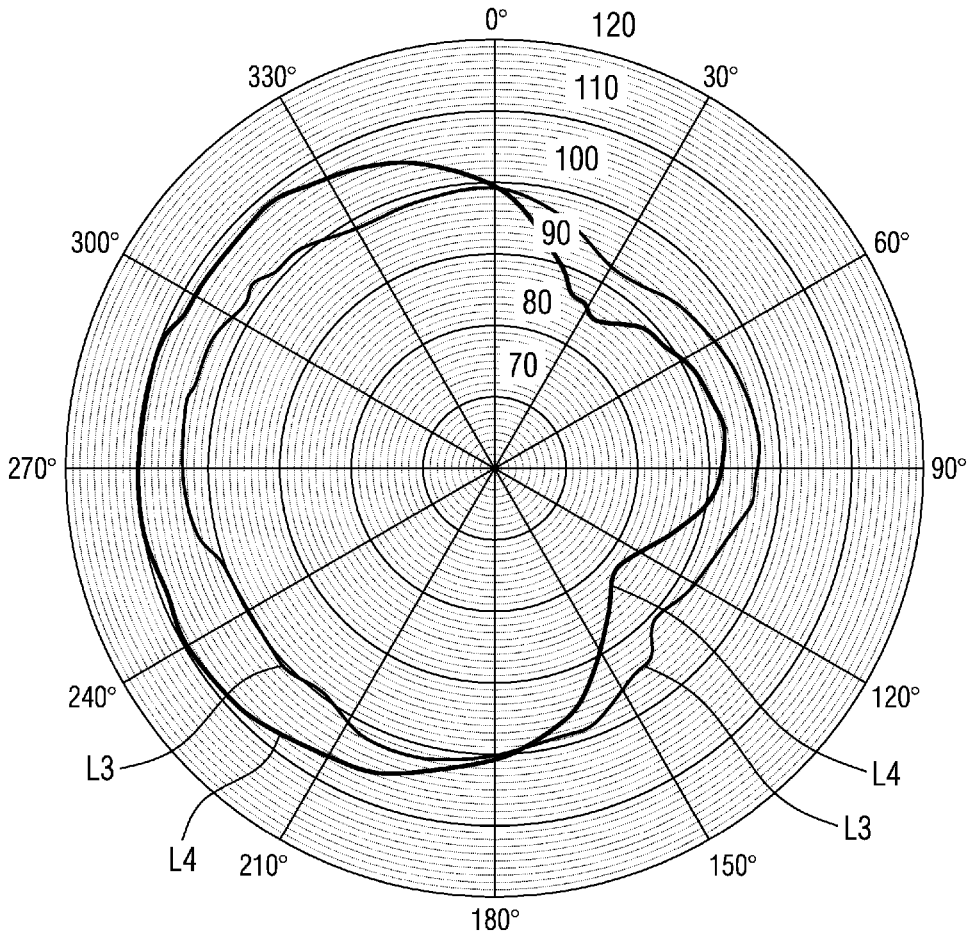
FIG. 2 shows a direction-dependently attenuated signal at 1 kHz after using Wiener filters for the left-side and right-side microphones

Illustrated in FIG. 2 is the direction-dependent attenuation which results when the Wiener formula is applied for a circumferential (360°) signal at 1 kHz. This results in the direction-dependently attenuated signal L4 for the left-side microphone or microphone system and L3 for the right-side microphone or microphone system.

In comparison with the previous figure, it can recognized that the interaural level differences are maintained. Signals from the right side are regarded as noise signals and reduced, signals from the left remain unattenuated. The spatial impression, in other words the signal information concerning where the respective signals come from, is maintained because the level differences are maintained. If signals are received from both sides, a reduction takes places depending on the ratio of the useful and noise sounds estimates according to the known Wiener formula.

As described previously, it is proposed to take advantage of the natural shadowing effect of the head in order to use the signals pre-filtered by the shadowing effect of the head as noise and useful sound signals for the determination of the input variables for an approach based on a filter, for example a Wiener filter, to obtaining relief from noise sound. Since the shadowing effect of the head is particularly pronounced at high frequencies (>700 Hz or >1 kHz) but continues to decrease towards lower frequencies, this method can be advantageously applied particularly for frequencies above 1 kHz.

For low frequencies (<1.5 kHz or <1 kHz), the previously described solution cannot be optimally applied on account of a too small shadowing effect of the head. In low frequency ranges, the method described in the following which can also be employed separately and exclusively can be used in addition.

Since it holds true for low frequencies (<1.5 kHz or <1 kHz) that the binaural microphone spacing on the head of a hearing aid user is sufficiently small in comparison with the wavelength, no spatial ambiguities arise ('spatial aliasing'). In the case of low frequencies (<1.5 kHz or <1 kHz) in the acoustic source signal, with the microphone system comprising a left-side and a right-side microphone or microphone system on the head of a hearing aid user it is therefore possible to calculate a conventional differential directional microphone which "looks" or "listens" to the side.

The output signal from such a directional microphone could indeed simply be used directly in order to produce a lateral directionality in the case of low frequencies. The directional signal determined in said manner could then be reproduced identically at both ears or hearing aids of the hearing aid user. This would however have the consequence that the localization capability in this frequency range would be lost because only one common output signal would be produced and presented for both ear sides.

Instead, therefore, both a signal directed to the left and also a signal directed to the right are calculated on the basis of a conventional directional microphone and, depending on the desired useful signal direction, said signals are used as noise or useful signals for a subsequent filtering, preferably using a Wiener filter. This filter is thereafter applied separately to each of the microphone signals from the microphone system and not to the common directional microphone signal calculated as the output signal from the conventional directional microphone.

Figure 3:
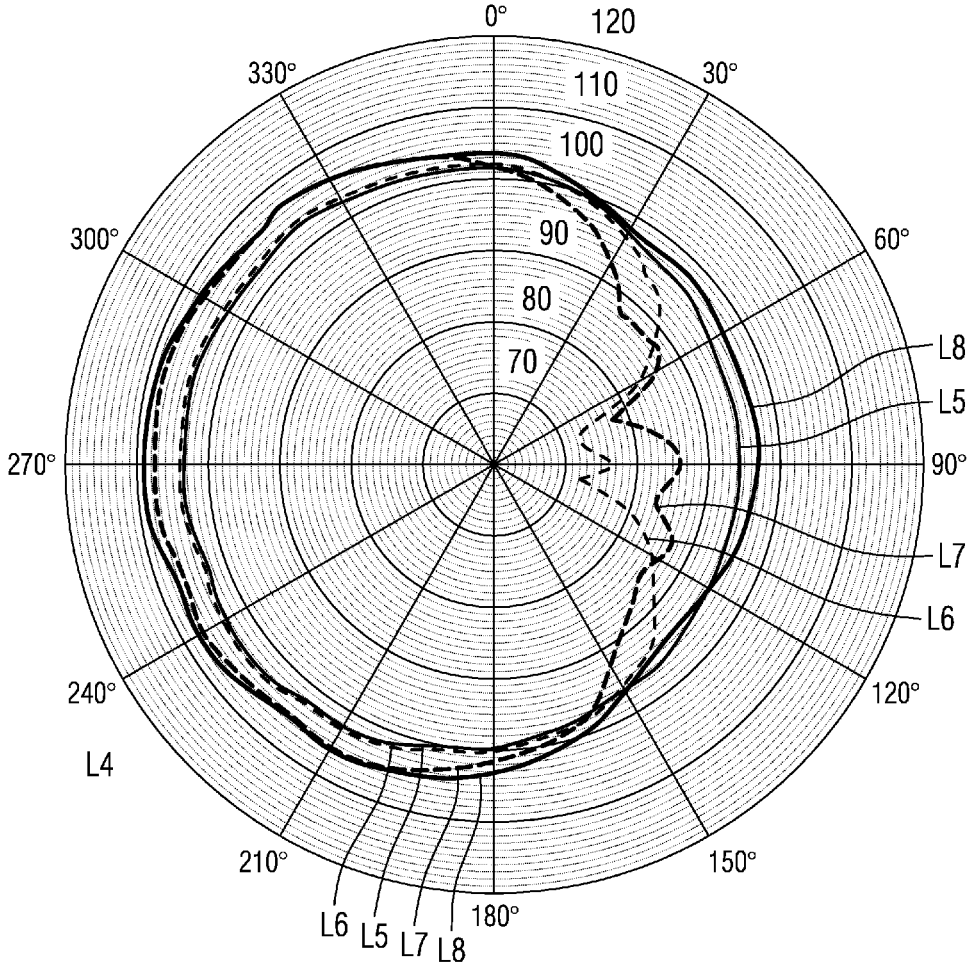
FIG. 3 shows a directed differential directional microphone signal and also a respective Wiener pre-filtered microphone signal for frequencies of 250 Hz and 500 Hz directed towards the left (at 270°)

FIG. 3 illustrates the effect of the previously described auditory signal processing in low frequency ranges. To this end, a "listen" or "look" directed to the left (at 270°) was calculated for frequencies of 250 Hz L8 and 500 Hz L5. In the context of the pre-filtering, a conventional differential directional microphone signal directed to the left was initially calculated as a useful signal, and one directed to the right as a noise signal (solid lines in the figure). The directed microphone signals have the usual cardioid/anticardioid (also abbreviated to: card/anticard) shaped direction-dependent sensitivity characteristic.

The useful signal level and noise signal level were determined or estimated from the useful signal and noise signal. Said levels were used as input variables for a Wiener filter, therefore:

Wiener filter=useful signal level/(useful signal level+noise signal level)

Such a Wiener filter was calculated for each frequency range (in the figure therefore 250 Hz and 500 Hz) for all spatial directions and applied individually to each of the directional microphone signals. For each of the directional microphone signals a Wiener pre-filtered direction-dependent sensitivity characteristic thereby results, which characteristics are represented in the figure by dashed lines L6 and L7.

It can be seen in the figure that in the noise signal direction (in other words, to the right, 90°) a greater attenuation is achieved than in the useful signal direction (in other words, to the left, 270°). It is furthermore apparent that the level differences are largely maintained (namely a higher level for the left-side L7 in comparison with the right-side microphone signal L6) and this means that a spatial association of the acoustic source signal continues to remain possible for the hearing aid user.

The filter methods described in the aforegoing for high and low frequency ranges can be employed for example in hearing instruments to be worn on the head individually in each case for high or for low frequencies. They can however also be employed in combination and complement each other in a particularly advantageous manner in this situation across the entire frequency range of a hearing instrument to be worn on the head.

Figure 4:
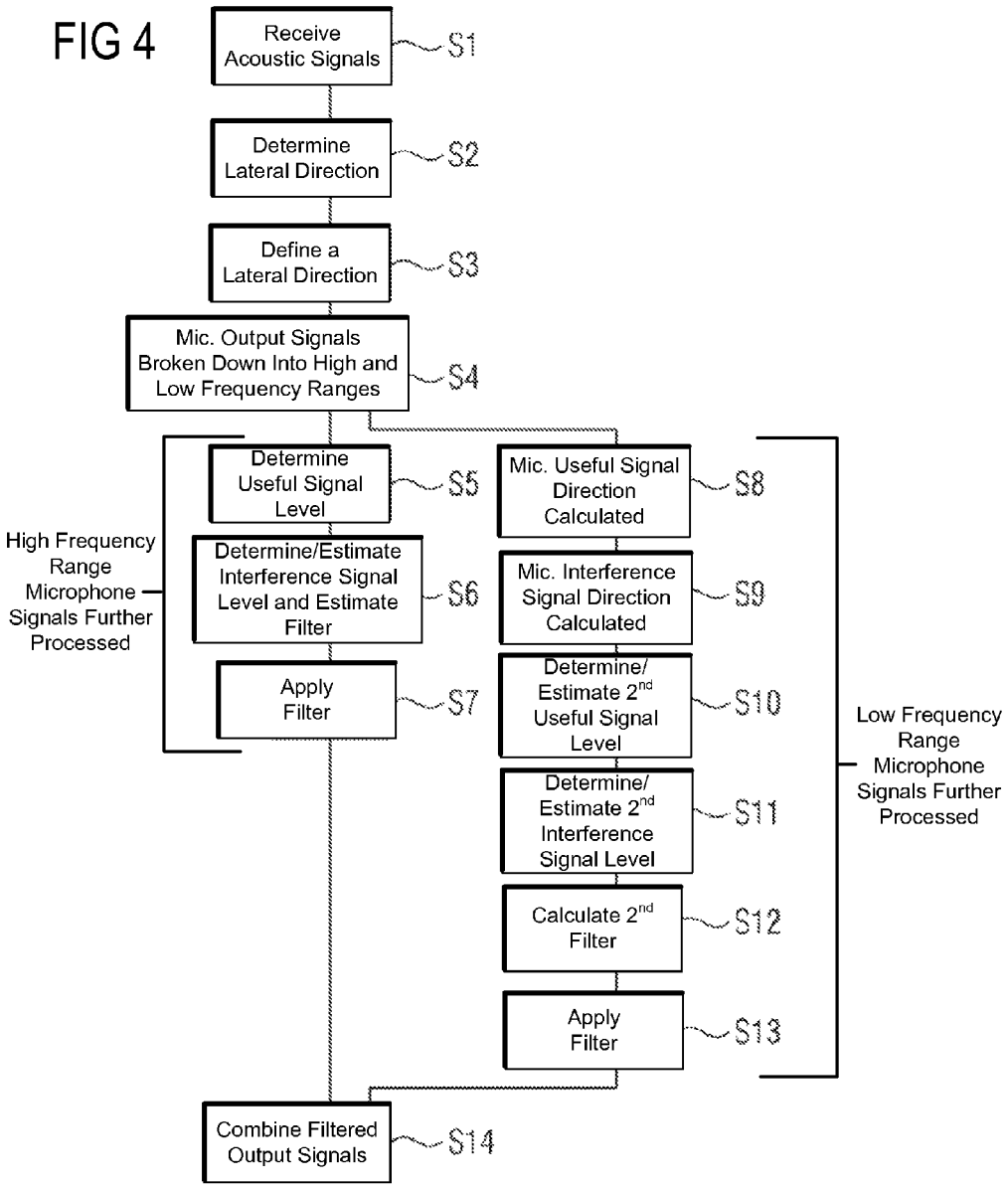
FIG. 4 shows a schematic illustration of the method for improving the signal-to-noise ratio for binaural left-right localization

FIG. 4 schematically illustrates the method described in the aforegoing for improving the signal-to-noise ratio for binaural left-right localization.

In step S1, a binaural microphone system captures acoustic signals. Such a microphone system comprises at least two microphones, to be worn one each side on the left or right on the head of a hearing aid user. The respective microphone system can in each case also comprise a plurality of microphones which can for example enable a directionality to the front and to the rear for the localization.

In step S2, a lateral direction is defined in which the highest sensitivity of the microphone system is to be directed. The direction can for example be defined automatically depending on an acoustic analysis of the ambient noises or depending on a user input. The spatial direction in which the source of the acoustic useful signals is located or is presumed to be located is chosen as the direction of highest sensitivity. In the present situation it is therefore also referred to as the useful signal direction. By analogy, the microphone or microphone system situated in this direction is also referred to as the useful signal microphone in the present situation.

In step S3, by analogy with the step described above, a lateral direction is defined in which the lowest sensitivity of the microphone system is to be directed. In the present situation it is therefore also referred to as the noise signal direction and the microphone or microphone system situated in this direction is also referred to as the noise signal microphone.

In step S4, the output signals from the microphones are split into a frequency range having high frequencies above a cutoff frequency of at least 700 Hz, possibly also 1 kHz, and a frequency range having low frequencies below a cutoff frequency of 1.5 kHz, possibly also 1 kHz.

In steps S5 to S7, the microphone signals in the high frequency range are processed further. In step S5, a useful signal level is determined or estimated depending on the output signal from the useful signal microphone.

In step S6, a noise signal level is determined or estimated depending on the output signal from the noise signal microphone.

In step S6, a filter, preferably a Wiener filter, is calculated using the useful signal level and noise signal level determined in the aforegoing. The signal levels and the filtering can be determined for the entire high frequency range. It is however also possible for a split into frequency bands within the high frequency range to be effected and the filtering can be carried out individually for each of the frequency bands.

In step S7, the previously calculated filter is applied separately to the respective output signals from the right-side microphone and the left-side microphone or microphone system in the high frequency range.

In steps S8 to S13, the microphone signals of the low frequency range are processed further. In step S8, a conventional differential binaural directional microphone having high sensitivity in the useful signal direction is calculated, as a result of which a second useful signal is obtained.

In step S9, a conventional differential binaural directional microphone having high sensitivity in the noise signal direction is calculated, as a result of which a second noise signal is obtained.

In step S10, a second useful signal level is determined or estimated depending on the second useful signal.

In step S11, a second noise signal level is determined or estimated depending on the second noise signal.

In step S12, a second filter, preferably a Wiener filter, is calculated using the second useful signal level and second noise signal level determined in the aforegoing. The second signal levels and the filtering can be determined for the entire low frequency range. It is however also possible for a split into frequency bands within the low frequency range to be effected and the filtering can be carried out individually for each of the frequency bands.

In step S13, the previously calculated filter is applied separately to the respective output signals from the right-side microphone and the left-side microphone or microphone system in the low frequency range.

In step S14, the filtered output signals from the microphones of both frequency ranges, or in the case of a further split into frequency bands of all frequency bands, are combined to produce one filtered output signal from the binaural microphone system.

An embodiment variant of the method not illustrated specifically in the figures comprises the steps listed below:

- capturing acoustic useful signals by means of at least two microphones, whereby one microphone is closer to the source of the acoustic useful signals than the other microphone,
- specifying one microphone situated closer to the source as the useful signal microphone and one microphone further away from the source as the noise signal microphone,
- specifying a relevant frequency range which includes frequencies higher than 700 Hz, determining a noise signal level in the relevant frequency range depending on the output signal from the noise signal microphone, determining a useful signal level in the relevant frequency range depending on the output signal from the useful signal microphone, and defining an amplification factor for the amplification of acoustic signals captured by the microphones depending on the estimated noise signal level and the estimated useful signal level.

In a development, the output signals from the microphones are split into frequency bands and the amplification factor is defined separately in each case for one or more of the frequency bands.

In a further development, the amplification factor (Wiener) is defined in accordance with the formula amplification factor (Wiener)=useful signal level/(useful signal level+noise signal level).

In a further development, the useful signal microphone is disposed on a hearing aid to be worn on the right side by a hearing aid user and the noise signal microphone on a hearing aid to be worn on the left side, or vice versa.

In a further development, one or more of the following is estimated as the useful signal level and/or as the noise signal level: energy, power, amplitude, smoothed amplitude, averaged amplitude, level.

A further development additionally comprises the following steps:

capturing acoustic useful signals by means of a microphone system comprising at least two microphones, whereby one microphone is closer to the source of the acoustic useful signals than the other microphone, specifying one microphone situated closer to the source as the useful signal microphone and one microphone further away from the source as the noise signal microphone, specifying a relevant frequency range which includes frequencies lower than 1.5 kHz, determining a noise signal by differential processing of the output signals from the microphone system, wherein a lower sensitivity is achieved in the direction of the microphone disposed closer to the source than in the opposite direction, in the relevant frequency range, determining a noise signal level depending on the noise signal, determining a useful signal by differential processing of the output signals from the microphone system, wherein a higher sensitivity of the microphone system is achieved in the direction of the microphone disposed closer to the source than in the opposite direction, in the relevant frequency range, determining a useful signal level depending on the useful signal, and defining an amplification factor for the amplification of acoustic signals captured by the microphones depending on the noise signal level and the useful signal level, whereby the amplification factor is applied separately to each output signal of the microphone system.

In a further development, the output signals from the microphones are split into frequency bands and the amplification factor is defined separately in each case for one or more of the frequency bands.

In a further development, the amplification factor (Wiener) is defined in accordance with the formula amplification factor (Wiener)=useful signal level/(useful signal level+noise signal level).

In a further development, the useful signal microphone is disposed on a hearing aid to be worn on the right side by a hearing aid user and the noise signal microphone on a hearing aid to be worn on the left side, or vice versa.

In a further development, one or more of the following is estimated as the useful signal level and/or as the noise signal level: energy, power, amplitude, smoothed amplitude, averaged amplitude, level.

In a further development, an amplification factor is defined in a low frequency range which includes frequencies lower than 1.5 kHz, as described in the immediately preceding sections, and an amplification factor is defined in a high frequency range which includes frequencies higher than 700 Hz, as described in the sections preceding the preceding sections.

The invention can be summarized as follows: the invention relates to a method and a system for improving the signal-to-noise ratio of output signals of a microphone system of two or more microphones due to acoustic useful signals occurring at the sides of the microphone system. Such a method and system can be used in hearing instruments, in particular in hearing aids which can be worn on the on the head of a hearing aid user. In order to solve this problem the invention proposes employing different processing for high and low frequency components (cutoff frequency in the range between 700 Hz and 1.5 kHz, for example approx. 1 kHz). In low frequency ranges, a differential microphone signal directed towards the left and one directed towards the right are produced in order to determine the levels of the lateral useful sound and noise sound on the basis of these two directed signals. Said levels are in turn used for a Wiener filtering and each of the microphone signals is subjected individually to the Wiener filtering. In addition, in high frequency ranges the natural shadowing effect of the head can be as a pre-filter for noise and useful sound estimation for a subsequent Wiener filtering. Subsequently, each of the microphone signals is subjected individually to the Wiener filtering. The methods can be employed for example in hearing instruments to be worn on the head individually in each case for high or for low frequencies, but they can also be employed in combination and complement each other in a particularly advantageous manner.

The invention claimed is:

1. A method for improving a signal-to-noise ratio of laterally occurring acoustic useful signals, the method comprising the following steps:

capturing acoustic signals with at least two microphones of a microphone system, one microphone being closer to a source of the acoustic signals than the other microphone;

specifying one spatial direction as a useful signal direction and one spatial direction as a noise signal direction;

determining a noise signal by differential processing of output signals from the microphone system, and achieving a lower sensitivity in the useful signal direction than in the noise signal direction;

determining a useful signal by differential processing of the output signals from the microphone system, and achieving a higher sensitivity of the microphone system in the useful signal direction than in the noise signal direction;

determining a noise signal level in dependence on the noise signal;

determining a useful signal level in dependence on the useful signal; and defining an amplification factor for amplification of acoustic signals captured by the microphones in dependence on the noise signal level and the useful signal level.

2. The method according to claim 1, which further comprises:

specifying a relevant frequency range including frequencies lower than 1.5 kHz.

3. The method according to claim 1, which further comprises:

specifying a relevant frequency range including frequencies lower than 1 kHz.

4. The method according to claim 2, which further comprises:

determining the useful signal level in the relevant frequency range.

5. The method according to claim 3, which further comprises:

determining the useful signal level in the relevant frequency range.

6. The method according to claim 2, which further comprises:

determining the noise signal level in the relevant frequency range.

7. The method according to claim 3, which further comprises:

determining the noise signal level in the relevant frequency range.

8. The method according to claim 1, which further comprises:

specifying the microphone situated closer to the source as a useful signal microphone and the microphone situated further away from the source as a noise signal microphone;

determining a second noise signal level in dependence on an output signal from the noise signal microphone;

determining a second useful signal level in dependence on an output signal from the useful signal microphone; and defining the amplification factor for amplification of acoustic signals captured by the microphones in dependence on the second noise signal level and the second useful signal level.

9. The method according to claim 8, which further comprises:

specifying a second relevant frequency range including frequencies higher than 700 Hz.

10. The method according to claim 8, which further comprises:

specifying a second relevant frequency range including frequencies higher than 1 kHz.

11. The method according to claim 9, which further comprises:

determining the second useful signal level in the second relevant frequency range.

12. The method according to claim 10, which further comprises:

determining the second useful signal level in the second relevant frequency range.

13. The method according to claim 9, which further comprises:

determining the second noise signal level in the second relevant frequency range.

14. The method according to claim 10, which further comprises:

determining the second noise signal level in the second relevant frequency range.

15. The method according to claim 1, which further comprises:

applying the amplification factor separately to each output signal of the microphone system.

16. The method according to claim 1, which further comprises:

splitting output signals from the microphones into frequency bands; and defining the amplification factor separately for at least one respective frequency band.

17. The method according to claim 1, which further comprises defining the amplification factor in direction-dependent fashion.

18. The method according to claim 1, which further comprises defining the amplification factor (Wiener) in accordance with a formula amplification factor (Wiener)=useful signal level/(useful signal level+noise signal level).

19. The method according to claim 1, which further comprises placing one of the useful or noise signal microphone on a hearing aid to be worn on the right side by a hearing aid user and placing the other of the useful or noise signal microphone on a hearing aid to be worn on the left side by a hearing aid user.

20. The method according to claim 1, which further comprises determining one or more of the following parameter values as at least one of the useful signal level or the noise signal level: energy, power, amplitude, smoothed amplitude, averaged amplitude or level.

* * * * *